US009327877B2

(12) United States Patent
Manera et al.

(10) Patent No.: US 9,327,877 B2
(45) Date of Patent: May 3, 2016

(54) UPWARDLY BIASING CHILD-RESISTANT CLOSURE FOR LIQUID MEDICAMENTS

(71) Applicants: David A. Manera, Buena, NJ (US); John B. Daly, Ocean City, NJ (US)

(72) Inventors: David A. Manera, Buena, NJ (US); John B. Daly, Ocean City, NJ (US)

(73) Assignee: Comar, LLC, Buena, NJ (US)

( * ) Notice: Subject to any disclaimer, the term of this patent is extended or adjusted under 35 U.S.C. 154(b) by 0 days.

(21) Appl. No.: 14/133,964

(22) Filed: Dec. 19, 2013

(65) Prior Publication Data

US 2014/0166608 A1 Jun. 19, 2014

Related U.S. Application Data

(60) Provisional application No. 61/739,445, filed on Dec. 19, 2012.

(51) Int. Cl.

| | |
|---|---|
| ***B65D 55/02*** | (2006.01) |
| ***B65D 41/06*** | (2006.01) |
| ***B65D 47/24*** | (2006.01) |

(52) U.S. Cl.

CPC ..... *B65D 41/06* (2013.01); *B65D 47/243* (2013.01); *B65D 2215/02* (2013.01)

(58) Field of Classification Search

CPC ..... B65D 41/40; B65D 41/32; B65D 51/18; B65D 51/00

USPC ..... 215/211, 349, 254.8, 237; 220/295, 220/252, 254.8, 259.3, 714, 203.23; 222/524, 525, 153.14

See application file for complete search history.

(56) References Cited

U.S. PATENT DOCUMENTS

| | | | | |
|---|---|---|---|---|
| 4,705,181 | A * | 11/1987 | Burke et al. | 215/220 |
| 5,316,161 | A | 5/1994 | Gargione | |
| 6,354,450 | B1 | 3/2002 | Zielinski | |
| 7,441,715 | B2 * | 10/2008 | Carta | 239/327 |
| 7,909,197 | B2 * | 3/2011 | Mikkelsen | 220/295 |
| 7,988,004 | B1 * | 8/2011 | Marret et al. | 215/252 |
| 8,292,103 | B2 * | 10/2012 | Weist | 215/252 |

OTHER PUBLICATIONS

U.S. Appl. No. 61/739,455.

* cited by examiner

*Primary Examiner* — Anthony Stashick
*Assistant Examiner* — Raven Collins
(74) *Attorney, Agent, or Firm* — James L. Gannon, II; Montgomery, McCracken, Walker & Rhoads, LLP

(57) ABSTRACT

A passive valve closure for liquid medicaments, configured to permit irreversible attachment to a pre-existing bottle and reversible engagement with a dosage cup bearing lugs such that when the dosage cup engages skirt lugs on the closure, a child-resistant closure is effected.

9 Claims, 4 Drawing Sheets

UPWARDLY BIASING CHILD-RESISTANT CLOSURE FOR LIQUID MEDICAMENTS

CROSS-REFERENCE TO RELATED APPLICATIONS

This application claims priority to U.S. Provisional Application 61/739,445 filed on Dec. 19, 2012, which is incorporated herein in its entirety.

FIELD OF THE INVENTION

The invention relates to improvements to child-resistant closures for dispensers of liquid medicaments, in particular dispensers of liquid medicaments, and thereby provides for reduced manufacturing and production costs by coupling a triggerable passive valve system with a child-resistant cap to provide a child-resistant closure with additional safety features without the need for manufacturing additional structures or pieces.

BACKGROUND OF THE INVENTION

Child-resistant closures for medicaments have been known in the art for nearly fifty years. These closures generally require two opposed movements acting at the same time to overcome a locking mechanism. For example, one type of child-resistant cap requires a user to squeeze the cap at specific points, causing a deformation, and then to rotate the cap. If either the squeezing or rotating step is not performed, the cap cannot be opened. Another common method for imparting child-resistance on a cap is to require that the cap be pushed in a downward direction and then turned in order to be removed. Again, it can be seen that the two movements are opposed to one another; it is only through application of this unnatural combination of movements that the cap can be removed. Such a cap is disclosed in U.S. Pat. No. 5,316,161. However, when designing child-resistant closures, manufacturers are often forced to dedicate structures of the closure solely to the purpose of creating child-resistance. This results in increased manufacturing and overall packaging costs.

A passive valve is a valve which, in its resting state, is in a closed position, and which only moves to an open position when acted upon by an outside party, substance, or device. However, the passive valve only remains in this open state for the duration of the action by the party, substance, or device; upon cessation of the action, the valve reverts to its closed state. Thus passive valves differ from active valves, which require action by an outside party, substance, or device, to move from the closed position to the open position and further require an additional action to return to the closed position. In this respect, check valves are often considered to be passive valves, as they permit movement in one direction only and are generally found to be closed when no outside forces have been applied to them. Passive valves can therefore be considered "triggerable" in that an outside party, substance, or device "triggers" the valve to move from the closed position to an open position.

Passive or check valves are often of the cantilever, flap or lid variety (e.g., valves in the human heart), and function by mechanical displacement on account of a sufficient overpressure upstream of the valve. The same displacement is, however, not possible in the opposite direction, thus performing the basic function of a valve. Thus, a check-valve is designed to allow for temporal control of fluidic actuation. However, passive valves generally only require movement in a single direction to open the valve. Thus, a passive valve, on its own, would not necessarily impart child-resistance to a closure as a child may be able to trigger the valve to move from a closed position to an open position by simply applying force in a single direction. Thus the use of passive valves in closures for liquid medicaments, while beneficial, does not necessarily meet with industry and government standards for child-resistance, unless additional structures are added to impart child-resistance.

As a result, in light of the foregoing, it is clear that there is an unmet need in the art. Prior art child-resistant closures require an independent construction of all elements needed to impart child-resistance, while triggerable passive valves for the dispensation of liquid medicaments alone fail to create a child-resistant closure. Thus, the prior art required that manufacturers create bulky closures with each part serving a single, specific purpose, and thereby failed to maximize the ease of both manufacture and storage of child-resistant closures for liquid medicaments. The present invention, through its unique combination of features, overcomes the problem and meets the need for providing compact, triggerable passive-valve closures for liquid medicaments, requiring fewer manufactured parts to permit controlled, child-resistant access to the liquid medicament.

BRIEF SUMMARY OF THE INVENTION

The present invention provides a triggerable, passive valve closure capable of attachment to pre-existing, outwardly-threaded bottles of liquid medicaments, thus minimizing the quantity of components required to provide child-resistant closure and accurately dispense a liquid medicament.

In one embodiment, the closure has a collar, a plunger, and a tapered valve seal, such that the collar has spring features which permit compression in a downward direction and skirt lugs for engagement of complementary, mated lugs of a dosage cup, said skirt lugs being positioned such that engagement requires compression of the spring features.

Additional objects, advantages and novel features of the invention will be set forth in part in the description, examples and figures which follow, all of which are intended to be for illustrative purposes only, and not intended in any way to limit the invention, and in part will become apparent to those skilled in the art on examination of the following, or may be learned by practice of the invention.

BRIEF DESCRIPTION OF THE FIGURES

The foregoing summary, as well as the following detailed description of the invention, will be better understood when read in conjunction with the appended drawings. It should be understood, however, that the invention is not limited to the precise arrangements and instrumentalities shown.

DETAILED DESCRIPTION OF EXEMPLARY EMBODIMENTS OF THE INVENTION

Figure 1:
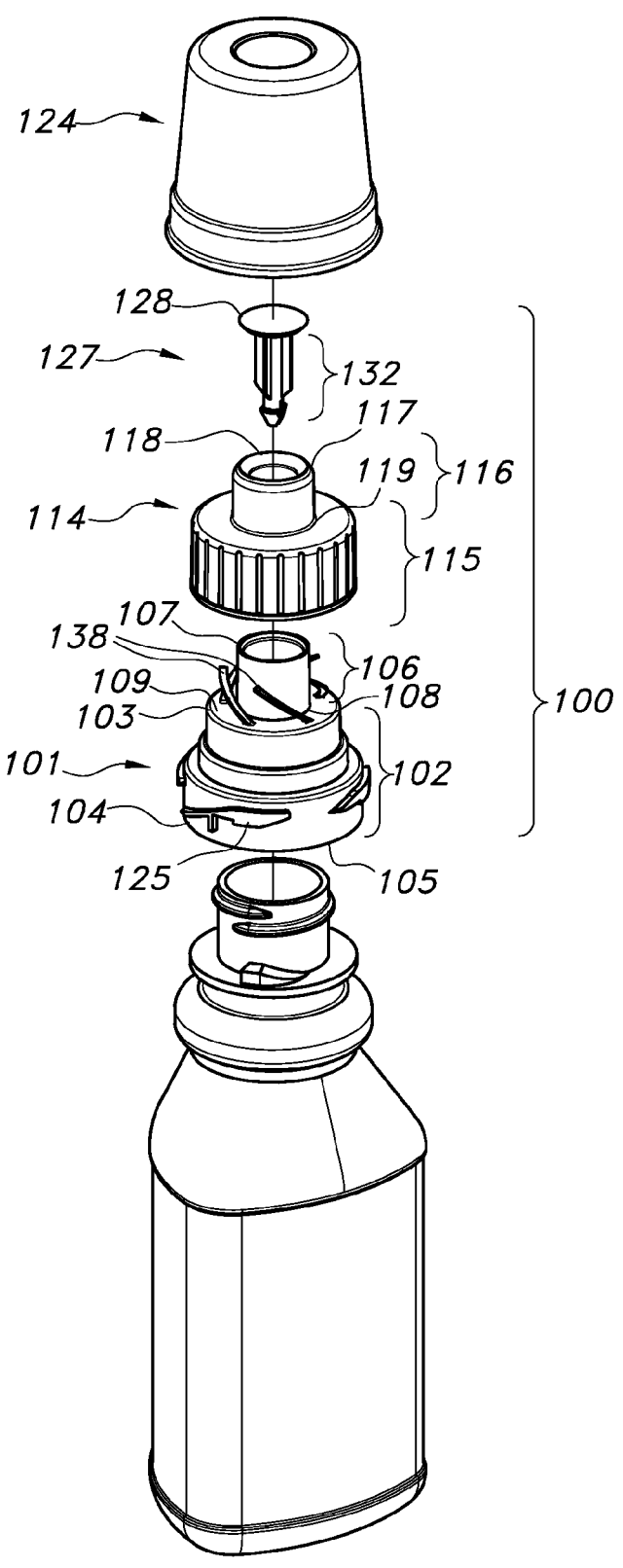
FIG. 1 shows an exploded view of the triggerable passive valve, dosage cup, and preexisting bottle.

For the purposes of the present disclosure, the term "lugs" shall be understood to mean one or both sets of grooves, ridges, or lugs configured to reversibly engage complementary grooves, ridges, or lugs to provide for child-resistant closure. Such helical lock grooves, ridges, and lugs are well known in the art, and similar lugs are described in, at least, U.S. Pat. No. 6,354,450.

The present invention may be constructed of laminated layers of plastic bonded with adhesive, or can be injection molded plastic. Suitable plastics include polyester, polycarbonate, acrylic, polystyrene, polyolefins, polyimides, and/or any other thermoplastic polymer. Further, the polyolefins referenced above include, but are not limited to polypropylene, as well as high-, medium-, and low-density polyethylene. These materials are known for their critical mechanical properties including, but not limited to, their flexural modulus, tensile strength, and elongation, and with the benefit of the present disclosure, one of ordinary skill in the art would understand that other materials exhibiting the same properties could be used in the construction of the cap, and therefore the invention is not limited to embodiments constructed of the materials listed above, but is intended to include all materials, whether presently known or developed in the future, which may exhibit similar structural properties.

The passive valve closure presented in the embodiments herein provides triggerable passive valves for controlling the flow of liquids (flow or no flow) from a preexisting bottle, preventing the outward passage of the liquids in the preexisting bottle without application of external compressive forces, and being capable of engagement with a dosage cup bearing lugs. The passive valve is designed to permit outward-flow only upon application of adequate compressive forces to the collar of the closure, and to negate leakage of liquid medicament into the dosage cup when in a capped state. To effect this, the closure is designed such that engagement of the lugs of the closure with mated, complementary lugs of the dosage cup requires that a compressive force be applied to the closure, and that disengagement of the lugs requires and additional compressive force be applied to the closure via the dosage cup, coupled with a rotation of the dosage cup, but the compressive force is not enough to move the valve from a closed position to an open state.

The present invention is compliant with current and 2013 Center for Communicable Disease (CDC) and Consumer Healthcare Products Association (CHPA) recommendations for child resistant closures over the counter (OTC) liquid medications. The present embodiments are characterized by a feature to lock the inventive CR cap onto a liquid reservoir, adapting it to present child resistant requirements, although the invention is not so limited. With the benefit of the present disclosure, one skilled in the art would be able to apply the disclosed concepts to any bottle capable of receiving a closure system. In addition each embodiment is characterized for use with a dosage cup, and thus each provides helical lock lugs on the outer surface of the cap for CR attachment of the helical lock dosage cup.

Referring now to the drawings, and more particularly FIG. 1, passive valve closure 100 includes collar 101, plunger 114, and tapered valve seal 127, and is adapted to be attached to the mouth of a pre-existing bottle.

Figure 2:
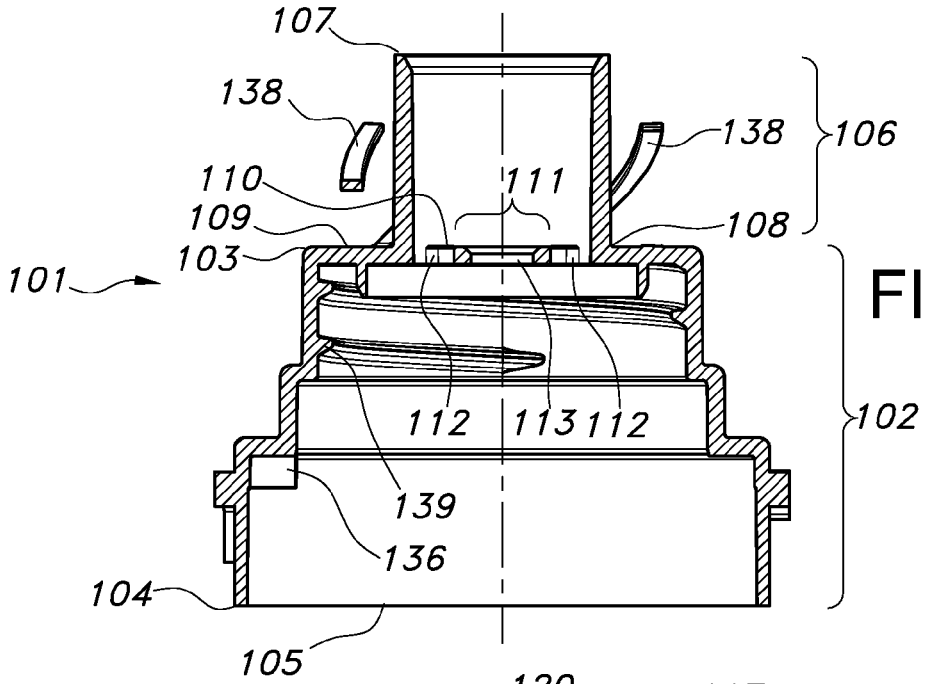
FIG. 2 shows a cross-sectional view of the collar of the triggerable passive valve.

As can be seen in FIG. 2, collar 101 has skirt 102, cylinder 106, horizontal shoulder 109, and internal platform 110.

Figure 7:
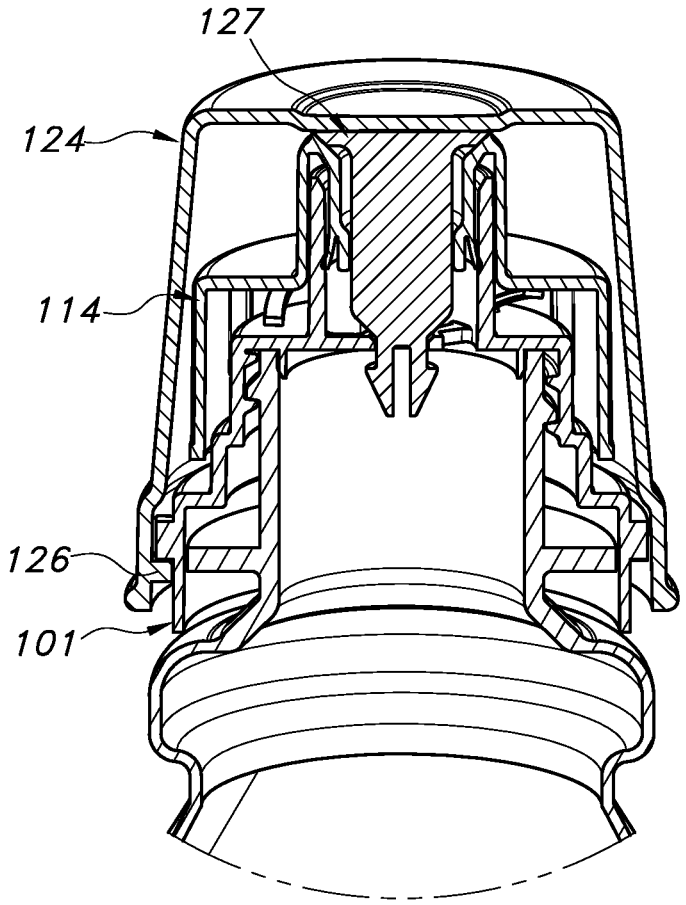
FIG. 7 shows the triggerable passive valve in the capped, child-resistant position.

Skirt 102 is generally tubular in shape, with a diameter greater than that of cylinder 106. Skirt 102 has upper end 103 and lower end 104 and a diameter 105, which can also be seen in FIG. 1. Skirt 102 has a central longitudinal axis which is shared by cylinder 106. In one embodiment, skirt 102 is of a uniform diameter. In an alternative embodiment, skirt 102 has several sections, each with progressively smaller diameters. In all embodiments, diameter 105 of skirt 102, or the separate diameters of each section of skirt 102, is greater than the diameter of cylinder 106. Located on an internal surface of skirt 102 are attachment means 139, such as threads designed to mate with complementary threads on the neck finish of a pre-existing bottle, or other attachment means known to one of ordinary skill in the art. Additionally, the internal surface of skirt 102 is adapted to provide irreversible locking means 136 to the pre-existing bottle. Finally, the exterior surface of skirt 102 has skirt lugs 125 for reversibly attaching dosage cup 124 to the closure in a child-resistant fashion via complementary, mated cap lugs 126 on dosage cup 124, as shown in FIGS. 1 and 7.

Cylinder 106 has top end 107 and bottom end 108 and a diameter. Both top end 107 and bottom end 108 are open and are configured to accept mated plunger 114. Further, cylinder 106 has a central longitudinal axis which is shared by skirt 102.

Horizontal shoulder 109 connects bottom end 108 of cylinder 106 to upper end 103 of skirt 102 and compensates for the variance in diameter between the two structures. Horizontal shoulder 109 further comprises spring features 138 extending upwardly such that when spring features 138 are compressed, the topmost portion of spring features 138 is manually pressed toward horizontal shoulder 109. Spring features 138 permit compression in a downward direction of a predetermined length. In one embodiment, spring features 138 are leaf springs, as the use of a leaf spring is often preferred to provide smooth functioning of the device because of the absence of friction and backlash. However, with the benefit of the present disclosure, one skilled in the art would understand that any number of spring-like mechanisms could be used in the manner described, and thus the invention is not limited to the embodiment specifically recited above.

Located internal to collar 101 is internal platform 110. Internal platform 110 is located at a height approximately equivalent to that of horizontal shoulder 109. Further, internal platform 110 has core 111. Spaced around core 111 are a plurality of exit ports 112, each exit port 112 having a central longitudinal axis parallel to the shared central axis of cylinder 106 and skirt 102, and providing a passageway for liquid medicament to flow from the pre-existing bottle into a cavity created by the interior surface of cylinder 106. In one embodiment, the plurality of exit ports 112 is four exit ports. When the passive valve is in the open position, liquid medicament is permitted to flow through exit ports 112, into the cavity created by the interior surface of cylinder 106, along the conduit created by cross-shaped shaft 132, and out of top opening 121 for dispensing. Core 111 contains central channel 113, configured to accept stem 135, and having a longitudinal axis shared with the axis of the cylinder and the skirt.

Figure 3:
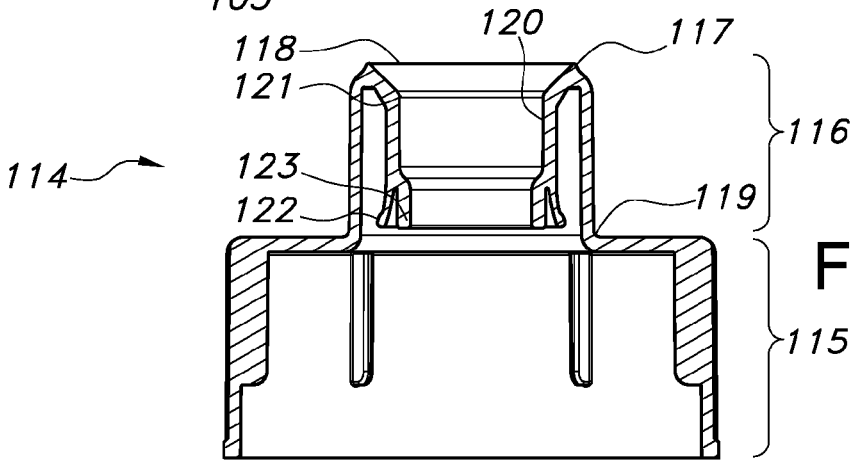
FIG. 3 shows a cross-sectional view of the plunger of the triggerable passive valve.

As can be seen in FIG. 3, plunger 114 has flange 115, outer shell 116, and inner assembly 120. Flange 115 extends radially outward from a centerline of the closure and is configured to accept compressive forces applied by the fingers of a user such that, as a result of the compression, 114 plunger moves in a vertical direction relative to collar 101, which remains stationary. In one embodiment the centerline of the closure is the shared central axis of the stem, cylinder, and skirt. Vertical movement of plunger 114 is effected by flange 115 imparting downward force onto spring features 138, thus compressing spring features 138. In one embodiment, flange is a horizontal shelf. In an alternative embodiment, as depicted in the figures, flange 115 has a horizontal shelf and a flange skirt depending downward therefrom.

Outer shell 116 has top end 117 and bottom end 119. Additionally, outer shell 116 has a diameter greater than that of cylinder 106, but less than that of skirt 102. Top end 117 has top ring 118, which serves as a transition point connecting outer shell to inner assembly 120. In one embodiment, top ring 118 is configured to accept induction foil or another means of sealing plunger 114 in a tamper-resistant, hygienic, or other fashion. Top ring 118 is connected, in turn, to inner assembly 120 of plunger 114.

Inner assembly 120 of plunger 114 is an insert mated to fit within the diameter of cylinder 106. Inner assembly 120 extends downward into cylinder 106. Inner assembly 120 has a diameter smaller than that of cylinder 106 to permit such mated insertion. Inner assembly 120 has top end 121 and bottom end 123. Both top end 121 and bottom end 123 are open, creating top and bottom openings respectively, providing a passageway through which liquid medicaments may pass. Located on a surface of inner assembly 120 proximal to cylinder 106 is at least one sealing mechanism 122. Such sealing mechanisms 122 include, but are not limited to, wiper seals, O-rings, and other sealing mechanisms known to those skilled in the art. Sealing mechanisms 122 ensure that liquid medicament may only exit the pre-existing bottle by passing through cylinder 106 and then through inner assembly 120, preventing liquid medicament from accessing the space between collar 101 and plunger 114.

Figure 4:
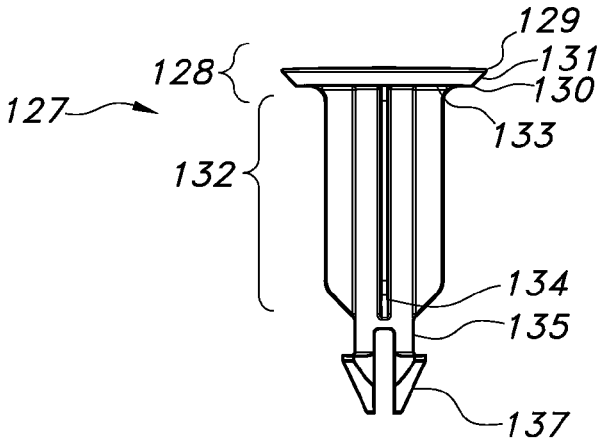
FIG. 4 shows a side view of the tapered valve seal of the triggerable passive valve.

As can be seen in FIG. 4, tapered valve seal 127 has a circular stopper 128, cross-shaped shaft 132, stem 135, and a terminal knob 137.

Circular stopper 128 is of a solid construction with upper diameter 129 and lower diameter 130. Upper diameter 129 is greater in size than lower diameter 130 and the two are connected via a tapered stopper wall 131. Upper diameter 129 of circular stopper 128 is equal to or greater than the inner diameter of top ring 118 of plunger 114. Lower diameter 130 of circular stopper 128 connects to top end 133 of cross-shaped shaft 132. When closure 100 is assembled, cross-shaped shaft 132 extends in a downward fashion through the passageway of the inner assembly. In one embodiment, bottom end 134 of cross-shaped shaft 132 tapers in cross-sectional diameter until it connects to stem 135.

Stem 135 has a top end and a bottom end, with the top end of stem 135 being the point where cross-shaped shaft 132 connects to stem 135. Stem 135 has a predetermined length. Additionally, stem 135 has diameter less than that of central channel 113. The bottom end of stem 135 is connected to terminal knob 137. Stem 135 is configured to extend through central channel 113. Terminal knob 137 has a diameter greater than central channel 113. Terminal knob 137 constructed in such a fashion that it may pass through central channel 113 in a downward direction relative to collar 101, but may not pass through central channel 113 in an upward direction. In one embodiment, the construction of stem 135 and terminal knob 137 is that of a "one-way barb" as known to those having ordinary skill in the art. However, the invention is not so limited to the commonly configuration of the "one-way barb" embodiment as set forth above and depicted in the figures. With the benefit of the present disclosure, one skilled in the art would be enabled to use any such combination of embodiments of stem 135 and terminal knob 137 which permit and restrict the movements as set forth above in conjunction with the present invention.

The passive valve is configured to engage a dosage cup 124 bearing cap lugs 126, as seen in FIG. 7. Dosage cup 124 may be one of any number of dosage cups known in the art. Dosage cup 124 has a bottom wall and side walls for containing the liquid medicament when dispensed. The side walls of dosage cup 124 have cap lugs 126 as referenced above. Cap lugs 126 are positioned on dosage cup 124, and skirt lugs 125 are positioned on skirt 102, at distances such that, a downward compressive force must be applied to dosage cup 124 to permit skirt lugs to engage cap lugs 126. To effect such engagement, the downward compressive force is transferred to tapered valve seal 127 and plunger 114 such that all three structures move in a downward vertical direction relative to collar 101. Thus, when dosage cup 124 has been attached to closure 100 via engagement of the plurality of skirt lugs 125 by the plurality of cap lugs 126, a downward force is exerted on spring features 138 by dosage cup 124 via tapered valve seal 127 and plunger 114, as shown in FIG. 7. In this position, spring features 138 have been deformed. As a result of being deformed into this compressed position, the resilience of the materials used in the construction of spring features 138 exert an upward force on plunger 114, which is in turn, transferred to tapered valve seal 127, and then to dosage cup 124. This upward biasing force causes the plurality of cap lugs 126 to engage the plurality of skirt lugs 125 in a child resistant manner. This child-resistance created by the need for an additional downward force sufficient to overcome the resilience of spring features 138 to be exerted on dosage cup 124 to permit the plurality of cap lugs 126 to clear the complementary portions of skirt lugs 125. This downward force must further be coupled with a rotational movement of dosage cup 124 in order to fully disengage cap lugs 126 from skirt lugs 125.

Closed, Open, and Capped Positions

Figure 5:
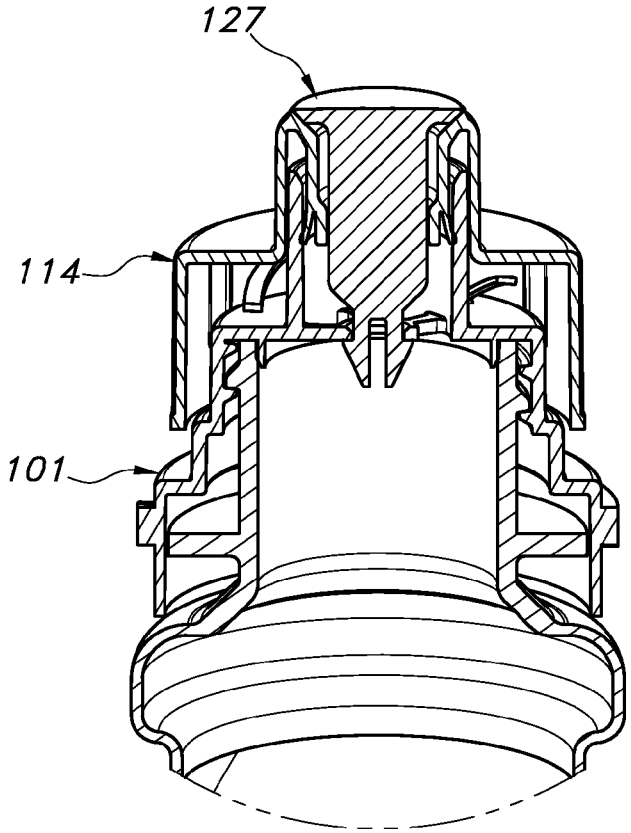
FIG. 5 shows the triggerable passive valve in the closed position.

The closure is capable of residing in three positions: closed position, open position, and capped position. In the closed position, as shown in FIG. 5, spring features exert 138 an upward force on plunger 114, which, in turn, exerts an upward force on tapered valve seal 125, and specifically on terminal knob 137. This force raises both plunger 114 and tapered valve seal 127, however the upward movement of these two components is stopped when terminal knob 137 comes into contact with the underside of core 111. The continued upward force exerted on plunger 114 by spring features 138 is transferred to the now-stationary tapered valve seal, thus providing a liquid-tight seal such that inversion of the bottle does not result in liquid medicaments exiting the closure.

Figure 6:
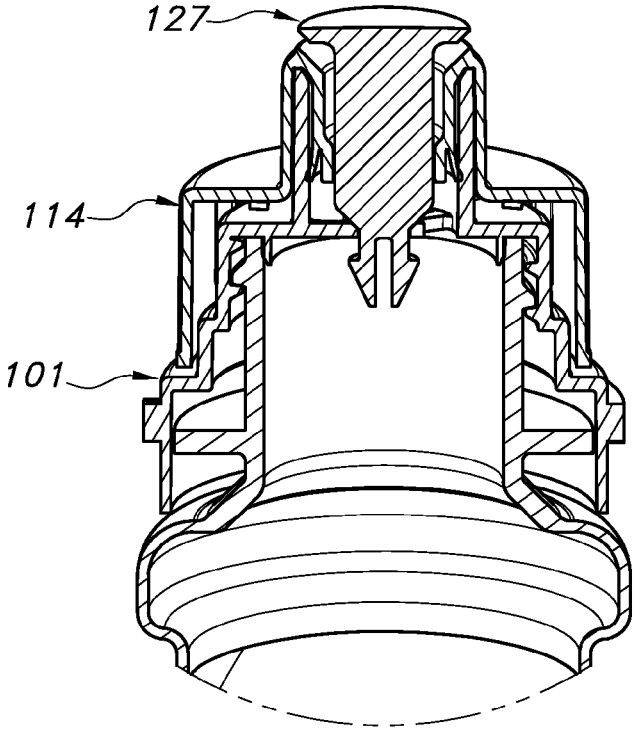
FIG. 6 shows the triggerable passive valve in the open position.

When manual external compressive force is applied to flange 115, plunger 114 travels in a downward direction relative to collar 101. The downward movement of plunger 114 releases the pressure exerted by the upward force on tapered valve seal 127. As such, tapered valve seal 127 moves in a downward fashion in tandem with the downward movement of plunger 114. The predetermined distance of downward compression permitted by spring features 138 is greater than the predetermined length of stem 135. As a result, the descent of tapered valve seal 127 is halted when tapered bottom 134 of cross-shaped shaft 127 comes in contact with central channel 113 of core 111. Continued downward pressure exerted on plunger 114, as allowed by the predetermined length of travel permitted by the spring features 138 results in continued downward movement of plunger 114, however, tapered valve seal 127 remains at the same height relative to collar 101. When spring features 138 have been fully compressed, plunger 114 has traveled a predetermined distance in the downward direction, however tapered valve seal 127 has traveled a shorter distance in the downward direction, thus resulting in a gap of a predetermined distance between top ring 117 of plunger 114 and tapered stopper wall 131 of tapered valve seal 127. This predetermined travel distance is directly related to the predetermined length of stem 135, as movement is effected along the predetermined length of the stem. When the compressive force is maintained and the bottle is inverted, the gap permits liquid medicament to flow out of the closure. This is the open position of the closure and is depicted in FIG. 6. When the compressive force is released, tapered valve seal 127 and plunger 114 move in an upward vertical direction relative to collar 101 until the closure reverts to its closed state, preventing the outflow of liquid medicaments.

The distance traveled by plunger 114 and the tapered valve seal 127, and therefore the size of the gap between the two, varies with the size of the preexisting bottle, the liquid medicament intended to be stored in the preexisting bottle, industry standards, and other factors as may be determined by a manufacturer or distributor of liquid medicaments. In one embodiment, plunger 114 travels between 0.03125 and 0.500 inches in the downward vertical direction. In an alternative embodiment, plunger 114 travels between 0.03125 and 0.250 inches in the downward vertical direction. In another embodiment, plunger 114 travels between 0.0625 and 0.1875 inches in the downward vertical direction. In a preferred embodiment, plunger 114 travels a distance of 0.125 inches in the downward vertical direction, resulting in a gap of between 0.050 inches and 0.060 inches between top ring and tapered stopper wall 131. However the invention is not so limited, and with the benefit of the present disclosure one skilled in the art would be able to apply the present invention to any container for liquids and produce a sealing mechanism with a gap appropriate for the container.

In the capped position, as shown in FIG. 7, dosage cup 124 has been inverted and cap lugs 126 have been threaded onto skirt lugs 125. In attaching dosage cup 124 to passive valve closure 100, a slight compressive force is exerted on the tapered valve seal, which transfers the force to plunger 114, and in turn, compresses spring features 138 as described above. The compressive force applied lowers both tapered valve seal 127 and plunger 114, however it does not move tapered valve seal 127 a distance great enough that tapered bottom 134 of cross-shaped shaft 132 comes in contact with central channel 113. As such, the resistance of spring features 138 to compression provides a force opposite to that of the compressive force applied by an outside actor such that a seal is maintained between tapered valve seal 127 and plunger 114, preventing outflow of liquid medicament. Dosage cup 124 is then rotated to fully engage the skirt lugs 125 lugs and reversibly lock dosage cup 124 in place. Removal of dosage cup 124 is effected by application of additional downward force to partially disengage cap lugs 126 from skirt lugs 125, rotation of dosage cup 124 to fully disengage skirt lugs 125, and removal of the compressive force. Once the compressive force has been removed, passive valve closure 100 reverts to the closed position as described above. Further, because the seal is maintained while the valve is in the capped position, liquid medicament is unable to exit plunger 114 and fill the cavity formed by the side walls and bottom wall of dosage cup 124, preventing unintentional spillage of liquid medicament, and accumulation of residual amounts of liquid medicament on the side walls and bottom wall of dosage cup 124.

As such, by utilizing the upward force inherently imparted by spring features 138 onto plunger 114 and tapered valve seal 127 to also provide an upward biasing force on dosage cup 124, the present invention reduces the number of structures necessary to effect child-resistant closure of a triggerable passive valve closure. Prior art methods for imparting an upward biasing force on dosage cup 124 were standalone features which failed to contemplate any potential interaction with the triggering of a passive valve closure and resulted in larger devices which were difficult to store and more costly to produce.

The disclosure of each patent, patent application and publication cited or described in this document is hereby incorporated herein by reference, in its entirety.

While the foregoing specification has been described with regard to certain preferred embodiments, and many details have been set forth for the purpose of illustration, it will be apparent to those skilled in the art without departing from the spirit and scope of the invention, that the invention may be subject to various modifications and additional embodiments, and that certain of the details described herein can be varied considerably without departing from the basic principles of the invention. Such modifications and additional embodiments are also intended to fall within the scope of the appended claims.

We claim:

1. A passive valve closure for attachment to a pre-existing bottle, the closure comprising:

a collar having
- a skirt, having an upper end, a lower end, and a diameter large enough to receive a neck of a pre-existing bottle,
- a cylinder having a top end, a bottom end, and a diameter smaller than the diameter of the skirt,
- a horizontal shoulder connecting the upper end of the skirt to the bottom end of the cylinder and having spring features attached thereto,
- and an internal platform, located internal to the collar at a height equivalent to the horizontal shoulder, the internal platform having
  - a core,
  - a plurality of exit ports spaced around the core,
  - a central channel configured to accept a plunger stem,
- the plurality of exit ports each having longitudinal axes parallel to a central shared axis of the central channel, cylinder, and skirt, a plunger having
- a flange extending radially outward from a centerline of the closure,
- an outer shell having
  - a top end having a top ring,
  - a bottom end,
  - a diameter greater than the diameter of the cylinder but smaller than the diameter of the skirt, and
- an inner assembly comprising an insert mated to fit within the cylinder, the insert having
  - at least one sealing mechanism,
  - a top end having a top opening, a bottom end having a bottom opening, the top opening and bottom opening thereby providing a passageway for the passage of liquid medicaments, and a tapered valve seal comprising
- a circular stopper having an upper diameter and a lower diameter, the upper diameter connected to the lower diameter by a stopper wall,
- a cross-shaped a shaft having a top end and a bottom end,
- a stem having a top end, a bottom end, and being configured to extend through the central channel,
- and a terminal knob,
- wherein the lower diameter of the circular stopper is connected to the top end of the cross-shaped shaft, the bottom end of the cross-shaped shaft is connected to the top end of the stem, and the bottom end of the stem is connected to a terminal knob.

2. The closure of claim 1, wherein the skirt further comprises an internal surface having attachment means configured to mate with complementary attachment means on the pre-existing bottle.

3. The closure of claim 1, wherein the bottom end of the cross-shaped shaft is tapered.

4. The closure of claim 1, wherein the terminal knob has a diameter greater than the central channel.

5. The closure of claim 1, wherein the stem has a predetermined length which permits movement of the plunger in an up-and-down direction relative to the collar.

6. The closure of claim 5, wherein the spring features permit compression in a downward direction of a predetermined length.

7. The closure of claim 6, wherein the predetermined length determined of the spring features is greater than the predetermined length of the stem.

8. The closure of claim 1, wherein the skirt further comprises an exterior having skirt lugs for engaging complementary, mated cap lugs of a dosage cup.

9. The closure of claim 8, wherein the cap lugs are positioned along a side wall of the dosage cup, at a distance from a bottom wall of the dosage cup, such that engagement of the skirt lugs by the cap lugs of an inverted dosage cup requires a compressive force be applied to the tapered valve seal.

* * * * *